US007918915B2

(12) United States Patent
Bergman et al.

(10) Patent No.: US 7,918,915 B2
(45) **Date of Patent: *Apr. 5, 2011**

(54) SPECIFIC CHROMIUM, MOLYBDENUM AND CARBON IRON-BASED METALLURGICAL POWDER COMPOSITION CAPABLE OF BETTER COMPRESSIBILITY AND METHOD OF PRODUCTION

(75) Inventors: Ola Bergman, Helsingborg (SE); Paul Nurthen, Tonbridge (GB)

(73) Assignee: Höganäs AB, Höganäs (SE)

( * ) Notice: Subject to any disclaimer, the term of this patent is extended or adjusted under 35 U.S.C. 154(b) by 733 days.

This patent is subject to a terminal disclaimer.

(21) Appl. No.: 11/902,042

(22) Filed: Sep. 18, 2007

(65) Prior Publication Data

US 2008/0075968 A1 Mar. 27, 2008

Related U.S. Application Data

(60) Provisional application No. 60/847,652, filed on Sep. 28, 2006.

(30) Foreign Application Priority Data

Sep. 22, 2006 (SE) ..... 0602006

(51) Int. Cl.
*B22F 1/00* (2006.01)

(52) U.S. Cl. ..... 75/240; 75/246; 148/513; 428/570

(58) Field of Classification Search ..... 75/240, 75/246, 255, 252, 950; 148/513; 420/69, 420/101; 428/570
See application file for complete search history.

(56) References Cited

U.S. PATENT DOCUMENTS 5,856,625 A 1/1999 Saunders et al.

FOREIGN PATENT DOCUMENTS

DE 19711642 * 3/1997

OTHER PUBLICATIONS

Chapter 1: "Introduction", pp. 1-21, in M. Sherif El-Eskandarany, Mechanical alloying for fabrication of advanced engineering material, Noyes Publications, published 2001.*

* cited by examiner

*Primary Examiner* — George Wyszomierski
*Assistant Examiner* — Mark L Shevin
(74) *Attorney, Agent, or Firm* — Buchanan Ingersoll & Rooney PC

(57) ABSTRACT

The present invention relates to a wear resistant iron-based powder, suitable for the production of pressed and sintered components, comprising 10-20% by weight of Cr, 0.5-5% by weight of Mo and 1-2% by weight of C. The powder is characterised in that it includes pre-alloyed water atomized iron-based powder particles and chromium carbide particles diffusion bonded onto said pre-alloyed powder particles. The invention also relates to a method of producing this powder.

14 Claims, No Drawings

SPECIFIC CHROMIUM, MOLYBDENUM AND CARBON IRON-BASED METALLURGICAL POWDER COMPOSITION CAPABLE OF BETTER COMPRESSIBILITY AND METHOD OF PRODUCTION

The benefit is claimed under 35 U.S.C. §119(a)-(d) of Swedish Application No. 0602006-9, filed Sep. 22, 2006, and under 35 U.S.C. §119(e) of U.S. Provisional Application No. 60/847,652, filed Sep. 28, 2006.

FIELD OF THE INVENTION

The present invention relates to an iron-based powder. Especially the invention concerns a powder suitable for the production of wear-resistant products.

BACKGROUND ART

Products having high wear-resistance are extensively used and there is a constant need for less expensive products having the same or better performance as/than existing products.

The manufacture of products having high wear-resistance may be based on e.g. powders, such as iron or iron-based powders, including carbon in the form of carbides.

Generally, carbides are very hard and have high melting points, characteristics which give them a high wear resistance in many applications. This wear resistance often makes carbides desirable as components in steels, e.g. high speed steels (HSS), that require a high wear resistance, such as steels for drills, lathes, valve seats and the likes. The Mo, W and V are strong carbide forming elements which make these elements especially interesting for the production of wear resistant products. Cr is another carbide forming element.

An article by E. Pagounis et al in Materials science and engineering A246, 1998, 221-234 discloses the preparation of a wear resistant material prepared from a steel powder, which is dry mixed with a ceramic powder of e.g. $Cr_3C_3$.

Although the materials known from this publication have good wear-resistant properties there is a need for less expensive products having the same or better performance. There is also a need for powders which do not exhibit the problems with segregation mentioned in the publication.

Thus it would be advantageous if expensive metals such as W, V and Nb could be dispensed with. It would also be beneficial if the materials could be prepared in a simple and cost-effective way.

SUMMARY OF THE INVENTION

It has now been found that inexpensive materials distinguished by a good wear-resistance may be obtained from an iron-based powder. More specifically the iron-based powder should include 10-20% by weight of Cr, 0.5-5% by weight of Mo, and 1-2% by weight of C, whereby the iron-based powder is characterised in that it includes pre-alloyed water atomised iron-based powder particles, and chromium carbide particles diffusion bonded onto said pre-alloyed powder particles.

As chromium is a much cheaper and more readily available carbide forming metal than other such metals used in conventional powders and hard phases with high wear resistance, the powder, and thus the compacted product, may be more inexpensively produced when chromium is used as the principal carbide forming metal. It has also unexpectedly been shown that powders having an adequate wear resistance for e.g. valve seat applications may be obtained with chromium as the principal carbide forming metal in accordance with the present invention.

Further, by using this powder, problems with segregation which often appear when using a powder composition consisting of powders of different alloying elements, and other additives, having different particle sizes and different densities are avoided. Also dusting problems are reduced or eliminated.

The new iron-based powder is also distinguished by good compressibility.

In accordance with the present invention this new powder may be obtained by mixing a pre-alloyed water atomised iron-based powder with particles of chromium carbide, and annealing the mixture whereby the particles of chromium carbide are diffusion bonded onto the particles of the pre-alloyed powder.

Further, the carbides of regular high speed steels are usually quite small, but in accordance with the present invention it has also been found that equally advantageous wear resistance may be obtained with comparatively large chromium carbides.

In order for the compacted product to have homogenous properties throughout its volume, it is important that all the different compounds of the powder are intimately mixed. As different alloying elements and other additives often have different particle sizes and different densities, powder compositions easily segregate unless measures are taken to counter this. According to the present invention the problems with segregation have been dealt with by providing a pre-alloyed iron-based powder and by binding the carbides to this iron-based powder by diffusion binding. Thus, all the different compounds of the powder are physically linked to each other, why the resulting powder is homogenous and runs no risk of segregation regardless of handling. This preparation of the powder also prevents dusting of small particles of individual compounds, such as graphite, which is common with other powder compositions.

By diffusion binding the carbides onto the outside of the pre-alloyed powder particles, a powder having better compressibility than a powder having the corresponding composition but with the carbides within the pre-alloyed powder particles is obtained.

The compressibility is also improved by the pre-alloyed powder being water atomised, rather than gas atomised or milled, as this gives rise to particles of relatively irregular form.

DETAILED DESCRIPTION OF PREFERRED EMBODIMENTS

The pre-alloyed water atomised iron-based powder may be a commercially available or otherwise obtainable iron-based powder, e.g. a tool steel powder such as H13 (Powdrex) which has good wear resistance in itself.

The pre-alloyed powder preferably has an average particle size in the range of 40-100 μm, preferably of about 80 μm.

The pre-alloyed powder contains chromium, 2-10% by weight, molybdenum, 0.5-5% by weight, and carbon, 0.1-1% by weight, the balance being iron, optional other alloying elements and inevitable impurities. The pre-alloyed powder may optionally include other alloying elements, such as tungsten, up to 3% by weight, vanadium, up to 3% by weight, and silicon, up to 2% by weight. Other alloying elements or additives may also optionally be included.

In a preferred embodiment the pre-alloyed powder consists of 3-7% by weight of Cr, 1-2% by weight of Mo, 0.2-0.5% by weight of C and balance Fe.

Although the main part of the carbides of the inventive powder are the diffusion bonded chromium carbides, some carbides may also be formed by carbide forming compounds in the pre-alloyed powder, such as the above mentioned chromium, molybdenum, tungsten and vanadium.

The chromium carbides of the inventive iron-based powder may be obtained through milling e.g. $Cr_3C_2$ to a desired particle size. Conveniently the carbide particles are prepared to a size of less than 45 μm, and advantageously to an average size of at least 8 μm, preferably to an average size in the range of 10-30 μm.

The diffusion bonded carbides advantageously make up 5-30% by volume, preferably 5-15% by volume, of the particles of the inventive powder.

In a preferred embodiment the inventive diffusion bonded powder consists of 10-15 wt % of Cr, 1-1.5 wt % of Mo, 0.5-1.5 wt % of V, 0.5-1.5 wt % of Si, 1-2 wt % of C and balance Fe.

The diffusion bonded powder of the invention may be mixed with other powder components, such as other iron-based powders, graphite, evaporative lubricants, solid lubricants, machinability enhancing agents etc, before compaction and sintering to produce a product with high wear resistance. One may e.g. mix the inventive powder with pure iron powder and graphite powder, or with a stainless steel powder. A lubricant, such as a wax, stearate, metal soap or the like, which facilitates the compaction and then evaporates during sintering, may be added, as well as a solid lubricant, such as MnS, $CaF_2$, $MoS_2$, which reduces friction during use of the sintered product and which also may enhance the machinability of the same. Also other machinability enhancing agents may be added, as well as other conventional additives of the powder metallurgical field.

EXAMPLE 1

A commercially available water atomised tool steel, H13 (5% Cr, 1.5% Mo, 1% V, 1% Si and 0.35% C) from Powdrex, was mixed with milled carbide powder ($Cr_3C_2$, <45 μm). The mixture was subsequently vacuum annealed at 1000° C. for 2 days, thus diffusion binding the carbide particles to the pre-alloyed H13 particles. The resulting diffusion bonded powder consisted of 13 wt % of Cr, 1.35 wt % of Mo, 0.9 wt % of V, 0.9 wt % of Si, 1.7 wt % of C and balance Fe.

The invention claimed is:

1. An iron-based powder for compression to form wear-resistant products comprising:

10-20% by weight of Cr;

0.5-5% by weight of Mo; and 1-2% by weight of C;

wherein said iron-based powder is formed by the diffusion bonding with annealing of chromium carbide particles onto the surfaces of a pre-alloyed water-atomised iron-based powder comprising:

2-10% by weight of Cr;

0.5-5% by weight of Mo; and 0.1-1% by weight of C, and wherein said iron-based powder exhibits better compressibility than an iron-based powder having the corresponding composition but without the utilization of said diffusion bonding with annealing of chromium carbide particles.

2. The iron-based powder according to claim 1, wherein the chromium carbide particles have an average size in the range of 8-45 μm.

3. The iron-based powder according to claim 1, wherein the chromium carbide particles have an average size in the range of 10-30 μm.

4. The iron-based powder according to claim 1, wherein said powder includes 5-30% by volume of chromium carbide.

5. The iron-based powder according to claim 1, consisting of 10-15 wt % of Cr, 1-1.5 wt % of Mo, 0.5-1.5 wt % of V, 0.5-1.5 wt % of Si, 1-2 wt % of C, and the balance Fe.

6. A method of producing an iron-based powder according to claim 1, comprising:

mixing particles of a pre-alloyed water atomised iron-based powder with particles of chromium carbide; and annealing the mixture, whereby the particles of chromium carbide are diffusion bonded onto the particles of the pre-alloyed powder.

7. The method according to claim 6, wherein the chromium carbide particles have an average size in the range of 8-45 μm.

8. The method according to claim 6, wherein the chromium carbide particles have an average size in the range of 10-30 μm.

9. The method according to claim 6, wherein the pre-alloyed powder consists of 3-7% by weight of Cr, 1-2% by weight of Mo, 0.2-0.5% by weight of C, and balance Fe.

10. The iron-based powder according to claim 2, consisting of 10-15 wt % of Cr, 1-1.5 wt % of Mo, 0.5-1.5 wt % of V, 0.5-1.5 wt % of Si, 1-2 wt % of C, and the balance Fe.

11. The iron-based powder according to claim 3, consisting of 10-15 wt % of Cr, 1-1.5 wt % of Mo, 0.5-1.5 wt % of V, 0.5-1.5 wt % of Si, 1-2 wt % of C, and the balance Fe.

12. The iron-based powder according to claim 4, consisting of 10-15 wt % of Cr, 1-1.5 wt % of Mo, 0.5-1.5 wt % of V, 0.5-1.5 wt % of Si, 1-2 wt % of C, and the balance Fe.

13. The method according to claim 7, wherein the pre-alloyed powder consists of 3-7% by weight of Cr, 1-2% by weight of Mo, 0.2-0.5% by weight of C, and balance Fe.

14. The method according to claim 8, wherein the pre-alloyed powder consists of 3-7% by weight of Cr, 1-2% by weight of Mo, 0.2-0.5% by weight of C, and balance Fe.

* * * * *